US007135989B2

(12) United States Patent
Parsons

(10) Patent No.: US 7,135,989 B2
(45) Date of Patent: Nov. 14, 2006

(54) PARALLEL FLOW VEHICLE TURN SYSTEM FOR TRAFFIC INTERSECTIONS

(76) Inventor: Gregory Fife Parsons, 7700 Pinehill Rd., Lewis Center, OH (US) 43035

( * ) Notice: Subject to any disclaimer, the term of this patent is extended or adjusted under 35 U.S.C. 154(b) by 299 days.

(21) Appl. No.: 10/951,001

(22) Filed: Sep. 27, 2004

(65) Prior Publication Data

US 2006/0071815 A1 Apr. 6, 2006

(51) Int. Cl.
*G08B 1/095* (2006.01)

(52) U.S. Cl. ..... 340/907; 401/1

(58) Field of Classification Search ..... 340/907; 404/1

See application file for complete search history.

(56) References Cited

U.S. PATENT DOCUMENTS 5,795,095 A * 8/1998 Heller ..... 404/1

* cited by examiner

*Primary Examiner*—Daniel Wu

*Assistant Examiner*—Travis R. Hunnings

(57) ABSTRACT

A system of traffic lanes and signal means for reducing the number of signal phases per repeating cycle of a signalized traffic intersection at grade. Opposed turn center lanes (24) adjoin opposed turn bypass lanes (20) that are substantially parallel and adjacent to the near side of the destination roadway approach lanes (10). Opposed turn bypass lanes (20) intersect with destination roadway approach lanes (10) and departure lanes (32) each respectively containing signal means (22) (12) (30). The system generally permits opposed turn traffic to proceed through the intersection in two phases. Phase φ1 provides opposed turn vehicles on the center lanes (24) to proceed onto the bypass lanes (20) during the destination roadway thru phase. Phase φ2 provides vehicles on the bypass lanes to proceed onto the departure lanes (32) of the destination roadway during the origination roadway thru phase. This system accommodates left-handed or right-handed driving conventions.

8 Claims, 13 Drawing Sheets

PARALLEL FLOW VEHICLE TURN SYSTEM FOR TRAFFIC INTERSECTIONS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to traffic intersections at grade specifically to an arrangement of left turn lanes and traffic signal means whereby a single signal cycle can be comprised of two or three signal phases.

BACKGROUND OF INVENTION

Traditionally, four leg traffic intersections with signal control require a minimum of four signal phases to permit each vehicular movement to proceed through the intersection without conflicting with traffic on other travel paths. The signal indications for each phase typically include a green indication meaning "proceed", a yellow indication meaning "caution", and a red indication meaning "stop".

While one traffic movement receives a green indication, other conflicting movements must remain stopped. When the indication changes from green to yellow, drivers slow in anticipation of a red stop indication. Upon changing to a red indication, all traffic is stopped at the intersection. Each change of indication within the phase induces delay reducing the efficiency of the intersection.

Since the 1950's, efforts have been made to develop a more efficient intersection by either reducing the number of conflict points, number of phases, or eliminating signal control altogether.

Eliminating signalization altogether for a substantial traffic volume at-grade intersection may be accomplished using a modern roundabout, a common intersection in the United Kingdom. Although the modern roundabout substantially reduces delay under certain circumstances, the signalized intersection continues to be a desirable method of traffic control and will outperform the modern roundabout on arterial streets carrying high thru traffic volumes.

Consequently, a primary challenge for traffic engineers is to implement signalization that minimizes travel delay. Multi phase signals (more than three phases) introduce undesirable delay that can be substantially reduced if signalization could be conducted in two or three phases per signal cycle as accomplished by this invention.

Two-phase signalized intersection designs substantially different to this invention include the quadrant intersection, median U-turn crossover intersection, and super street median crossover intersection, all of which differ in operation and geometry. The two-phase signalized intersection design known as a displaced turn is included here as similar prior art. In countries with left-handed direction of travel, the nomenclature is displaced right turn (DRT) and for right-hand direction of travel countries the nomenclature is displaced left turn (DLT). Other names that have been applied to the displaced turn are "continuous flow intersection" and "enhanced intersection", but referring to essentially the same design. For purposes of this invention, the DLT designation is used to refer to all displaced turn variations. References to the DLT date back to the 1950's and 1960's, but not until the 1990's has the DLT intersection received widespread attention. Although the DLT intersection is not widely known to the general public, the DLT has gained renewed interest among traffic engineers and transportation planners. Although few DLT's have actually been constructed worldwide to date, the intersection has been modeled in traffic micro simulation showing a much higher level of service than traditional signalized intersections.

The general operation of the DLT is to have left turning traffic cross opposing traffic from center left turn lanes in advance of the intersection onto left turn bypass lanes that parallel the approach roadway while destination cross street thru traffic has a green indication. Once the signal changes to the next phase, left turn traffic turns onto the cross street during the originating street thru traffic green indication phase. This pattern of crossing left turn traffic onto left turn bypass lanes results in reducing the signal operation to two phases, one for each thru movement with left turns accomplished in two stages.

The author is aware of two DLT variations. Variant DLTa involves left turning traffic traveling from the left turn bypass lanes onto departing thru lanes. The other variant DLTb involves left turning traffic traveling from the left turn bypass lanes onto right turn bypass lanes, thus bypassing the signal located on the departing thru lanes that otherwise stops the left turn crossover traffic as in the DLTa. The advantage of the DLTa variant is to have less traffic traveling on the right turn bypass lanes and avoids driver confusion of two possible left turn locations (departing thru lanes or right turn bypass lanes) as with the DLTb variant. The disadvantage of the DLTa is to have left turn traffic travel through three signals to complete a left turn, while the DLTb requires left turning traffic to travel through two signals.

Although operationally efficient, the DLT has physical limitations that severely reduce the practicality of its implementation. The DLT suffers from several disadvantages:

(a) The intersection is confusing to approaching left turning drivers because they are required to perform the cross over maneuver well in advance of the intersection (potentially several hundred feet).

(b) The approaching left turning traffic may navigate the reverse curves forming the cross over at higher speeds making the maneuver less safe. The high speed combined with driver confusion may lead to potential head-on collisions as drivers misjudge the proper travel path.

(c) A reduction in distance between intersections that shortens weave and driver decision-making distances. A nearby intersection can be adversely affected due to the shortened distance to the DLT and vice versa by forcing lanes to be overloaded since drivers have difficulty changing lanes within the short separation distance.

(d) The DLT restricts access to corner properties. Due to the length and configuration of the DLT, left turns from adjacent driveways would not be feasible and access into adjacent driveways generally can only be made from one direction.

(e) The DLT does not permit U-turns to be accomplished safely.

(f) The DLT requires additional widening in advance of the intersection to accommodate the left turn. When retrofitting an existing intersection with the DLT, the additional widening may result in costly impacts to adjoining properties.

(g) The DLT requires a large area that results in higher probability for impacts to natural, cultural, historical, and other resources that are protected by law.

(h) The total cost to implement the DLT at an existing intersection or on a new roadway can be very high due to the disadvantages described above.

The invention is irrespective of direction of travel, therefore, right-hand travel such as in the United States and left-hand travel such as in the United Kingdom is irrelevant. Consequently, the terminology henceforth reflects a neutrality toward handedness with the use of the term "opposed turn" meaning left turns for right-hand travel and right turns for left-hand travel, respectively, and the term "merged turn" meaning right turns for right-hand travel and a left turns for left-hand travel.

BACKGROUND OF INVENTION-OBJECTS AND ADVANTAGES

Accordingly, several advantages of this invention are:

(a) the opposed turn is more intuitive to the driver since it occurs from nearly the same location as opposed turns at traditional intersections in contrast to the DLT where the driver begins the opposed turn far in advance of the intersection;

(b) the opposed turn crosses opposing travel lanes with a small radius curve making the resulting opposed turn a safer maneuver and combined with a channelizing island the potential for wrong way accidents is nearly impossible;

(c) the opposed turn bypass lanes overlap with the destination roadway center opposed turn lanes resulting in a smaller intersection and greater weave length between nearby intersections than the DLT;

(d) access is enhanced to affected corner properties by allowing driveway ingress and egress from all directions;

(e) the retrofitting of existing intersections requires less work within the existing roadway with all additional pavements added to the outside;

(f) smaller area than the DLT, thus resulting in fewer potential impacts to national or local physical resources and private property;

(g) U-turns are physically possible where the maneuver is not at DLT's or traditional intersections with narrow or no medians;

(h) generally lower cost than the DLT due to lower property impacts and less construction yet operating at a similarly high level of service.

SUMMARY

In accordance with this invention, a continuous turnway is formed by the arrangement of opposed turn lanes and signal means applied to a traffic intersection containing two or more roadways in which opposed turns are performed from center opposed turn lanes onto opposed turn bypass lanes parallel to the destination approach lanes. The resulting signal operation can occur in two phases with the opposed turn traffic traversing the intersection or interchange in two phases per signal cycle.

DRAWINGS—FIGURES

In the drawings, closely related figures have the same number but different alphabetic suffixes.

DRAWINGS—REFERENCE NUMERALS

Figure 1:
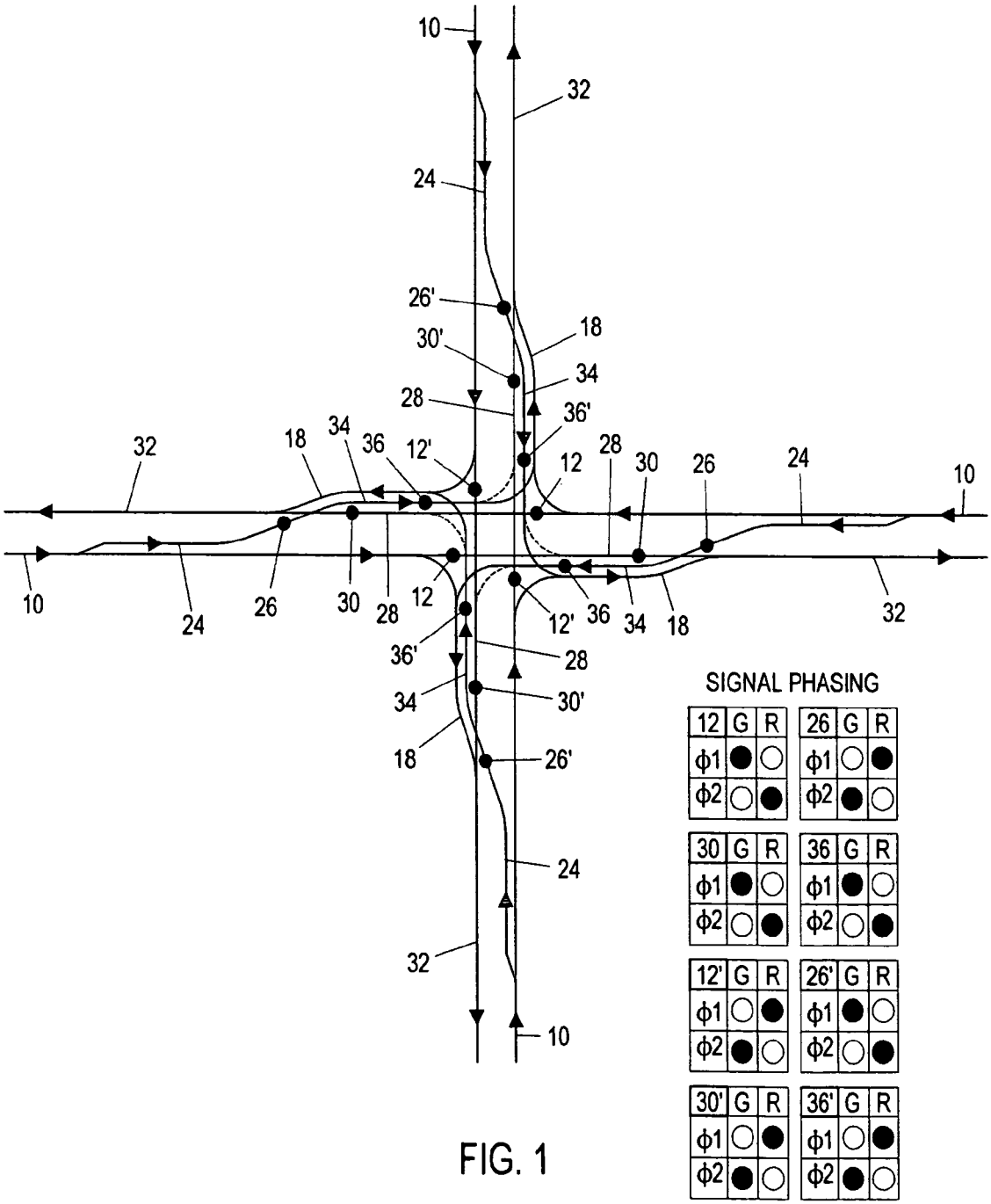
FIG. 1 PRIOR ART
FIG. 1 shows the prior art displaced left turn intersection as a line diagram.

10 approach lanes
12 approach signal
14 approach thru lanes
16 approach thru signal
18 merged turn bypass lanes
20 parallel flow opposed turn bypass lanes
22 parallel flow opposed turn bypass signal
24 opposed turn center lanes
26 opposed turn center signal
28 departure thru lanes
30 departure thru signal
32 departure lanes
34 DLT opposed turn bypass lanes
36 DLT opposed turn bypass signal
38 freeway lanes
40 freeway entrance ramp lanes
42 freeway exit ramp lanes
44 freeway ramp opposed turn lanes
46 freeway ramp opposed turn signal
48 freeway ramp merged turn lanes
50 bridge over or under freeway lanes

DETAILED DESCRIPTION—FIG. 1—PRIOR ART

The prior art displaced left turn (DLT) is illustrated as a line diagram in FIG. 1. The common DLT is two intersecting roadways that result in four roadway legs. Each leg of the DLT contains approach lanes 10 accommodating traffic approaching the intersection and departure lanes 32 accommodating traffic traveling away from the intersection each controlled by signal means 12, 12', 30, 30' respectively. Unlike conventional signalized roadway intersections, the DLT provides opposed turn center lanes 24 that are controlled by signal means 26, 26' in advance of the intersection. Opposed turn traffic proceed from opposed turn center lanes 24 onto opposed turn bypass lanes 34 that are parallel to the approach roadway and controlled by signal means 36, 36'. Traffic on the opposed turn bypass lanes 34 complete their opposed turn by proceeding onto either the departure thru lanes 28 (DLTa) or onto the merged turn bypass lanes 18 (DLTb). Traffic making opposed turns perform the movement in a complete signal cycle comprised of two phases. Approach thru traffic passing through the intersection proceeds onto departure thru lanes 34 that are controlled by signal means 30, 30', then exit the intersection on departure lanes 32. Merged turn traffic turns onto merged turn bypass lanes 18 from the approach lanes 10 and proceed to merge onto departure lanes 32 to exit the intersection.

Operation—FIG. 1

During signal phase ϕ1 of a repeating two-phase signal cycle, the following traffic operations occur for the common DLT:

1) thru traffic on east-west roadway approach lanes 10 receive a green indication from signal means 12 and proceed onto departure thru lanes 28;

2) departing traffic on east-west roadway departure thru lanes 28 receive a green indication from signal means 30 and proceed onto departure lanes then exit the intersection;

3) opposed turn traffic on east-west opposed turn center lanes 24 receive a red indication from signal means 26 and are stopped;

4) opposed turn traffic on east-west opposed turn bypass lanes 34 receive a green indication from signal means 36 and proceed onto north-south roadway departure thru lanes 28 (DLTa) or onto east-west roadway merged turn bypass lanes 18 (DLTb);

5) thru traffic on north-south roadway approach lanes 10 receive a red indication from signal means 12' and are stopped;

6) departing traffic on north-south roadway departure thru lanes 28 receive a red indication from signal means 30' and are stopped;

7) opposed turn traffic on north-south opposed turn center lanes 24 receive a green indication from signal means 26' and proceed onto opposed turn bypass lanes 34;

8) opposed turn traffic on north-south opposed turn bypass lanes 34 receive a red indication from signal means 36' and are stopped;

9) merged turn traffic on east-west roadway turn onto east-west merged turn bypass lanes 18 and proceed to merge onto north-south departure lanes 32 then exit the intersection;

10) merged turn traffic on north-south roadway turn onto north-south merged turn bypass lanes 18 and proceed to merge onto east-west departure lanes 32 then exit the intersection;

Signal phase ϕ2 operates in the same manner as signal phase ϕ1, but with the signal indications reversed.

DETAILED DESCRIPTION—FIG. 2—PREFERRED EMBODIMENT

Figure 2:
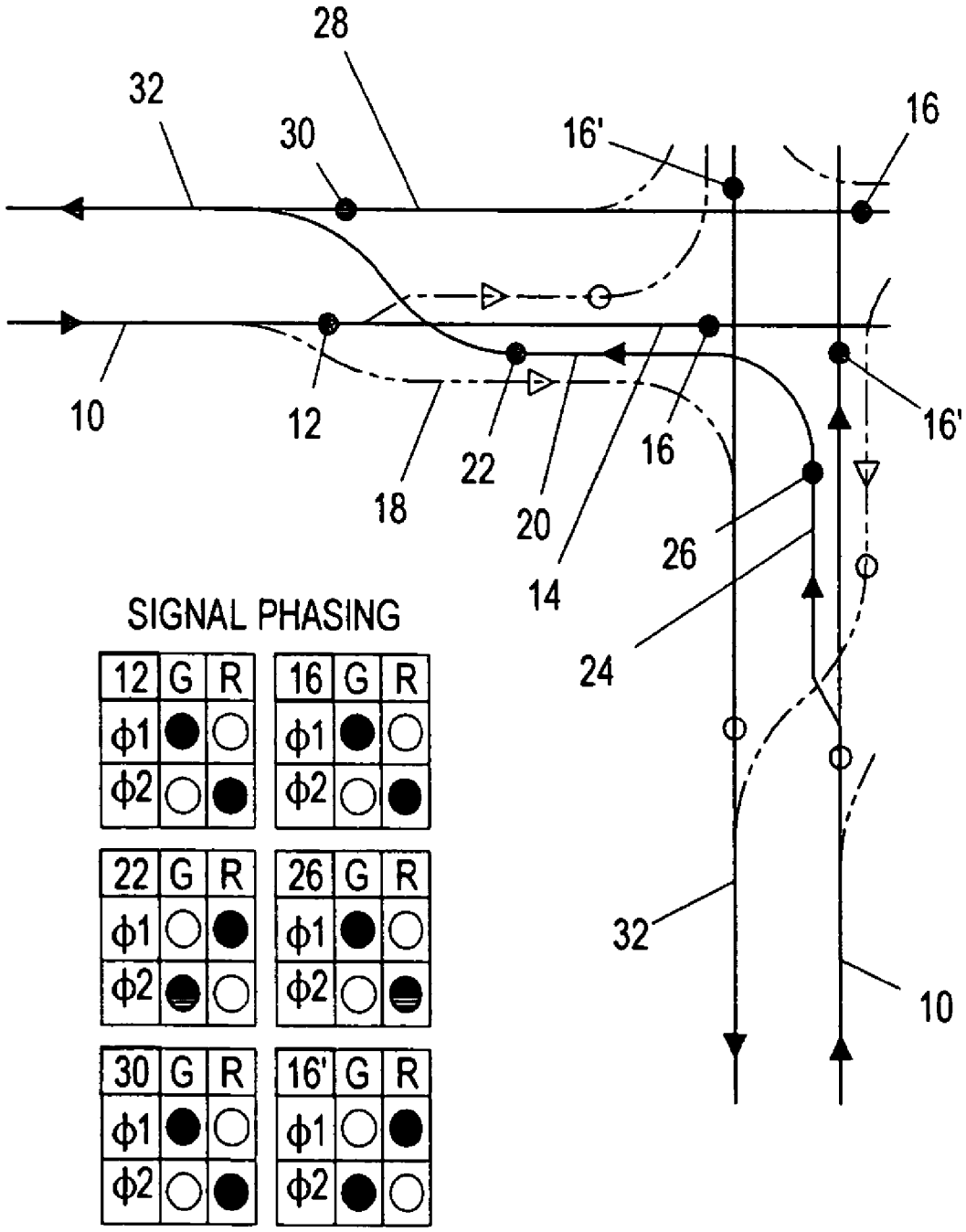
FIG. 2 shows the essential elements of the parallel flow vehicle turn system for traffic intersections as a line diagram.

A preferred embodiment arrangement of opposed turn lanes and signal means is illustrated as a line diagram in FIG. 2. The arrangement provides for approach lanes 10 whereby opposed turn traffic enter opposed turn center lanes 24 that are signal controlled 26. Upon receiving a green indication from the opposed turn signal means 26, traffic proceeds onto opposed turn bypass lanes 20 that are substantially parallel and near to the crossroad thru approach lanes 14. The opposed turn bypass lanes 20 are signal controlled 22. Upon receiving a green indication from the opposed turn bypass signal means 22, traffic proceeds onto departure thru lanes 32 and exits the intersection. Merged turn crossroad traffic travels from crossroad approach lanes 10 onto merged turn bypass lanes 18 and proceeds to merge onto departure lanes 32. A signal means 12 located on the crossroad coordinates flow of crossroad thru and opposed turn traffic with the opposed turn bypass lanes 20. Signal means 16 and 16' located at the intersection coordinate traffic movements between the road and crossroad thru traffic. The lane arrangement described above would occur on two or more legs of a roadway intersection such that the resulting signal operation could be minimized to two or three phases.

Operation—FIG. 2

During signal phase ϕ1 of a repeating two-phase signal cycle, the following traffic operations can occur for the traffic intersection configured with the parallel flow lane arrangement:

1) thru traffic on north-south roadway approach lanes 10 receive a green indication from signal means 16 and proceed through the intersection;

2) thru traffic on east-west roadway approach lanes 10 receive a red indication from signal means 12 and are stopped;

3) thru traffic on east-west approach thru lanes 14 receive red indication from signal means 16' and are stopped;

4) opposed turn traffic on north-south opposed turn center lanes 24 receive a red indication from signal means 26 and are stopped;

5) opposed turn traffic on the north-south opposed turn bypass lanes 20 receive a green indication from signal means 22 and proceed onto east-west roadway departure lanes 32 then exit the intersection;

6) thru traffic on east-west departure thru lanes 28 receive a red indication from signal means 30 and are stopped;

7) merged turn traffic on east-west approach lanes 10 turn onto merged turn bypass lanes 18 and proceed to merge onto north-south departure lanes 32 then exit the intersection.

During signal phase ϕ2, the following traffic operations can occur:

1) thru traffic on north-south roadway approach lanes 10 receive a red indication from signal means 16 and are stopped;

2) thru traffic on east-west roadway approach lanes 10 receive a green indication from signal means 12 and proceed onto east-west approach lanes 14;

3) thru traffic on east-west approach thru lanes 14 receive green indication from signal means 16' and proceed through the intersection;

4) opposed turn traffic on north-south opposed turn center lanes 24 receive a green indication from signal means 26 and proceed onto the north-south opposed turn bypass lanes 20;

5) opposed turn traffic on the north-south opposed turn bypass lanes 20 receive a red indication from signal means 22 and are stopped;

6) thru traffic on east-west departure thru lanes 28 receive a green indication from signal means 30 and proceed to exit the intersection;

7) merged turn traffic on east-west approach lanes 10 turn onto merged turn bypass lanes 18 and proceed to merge onto north-south departure lanes 32 then exit the intersection.

DETAILED DESCRIPTION—FIGS. 3A TO 3F—ADDITIONAL EMBODIMENT—TWO PHASE FOUR LEG INTERSECTION

Figure 3A:
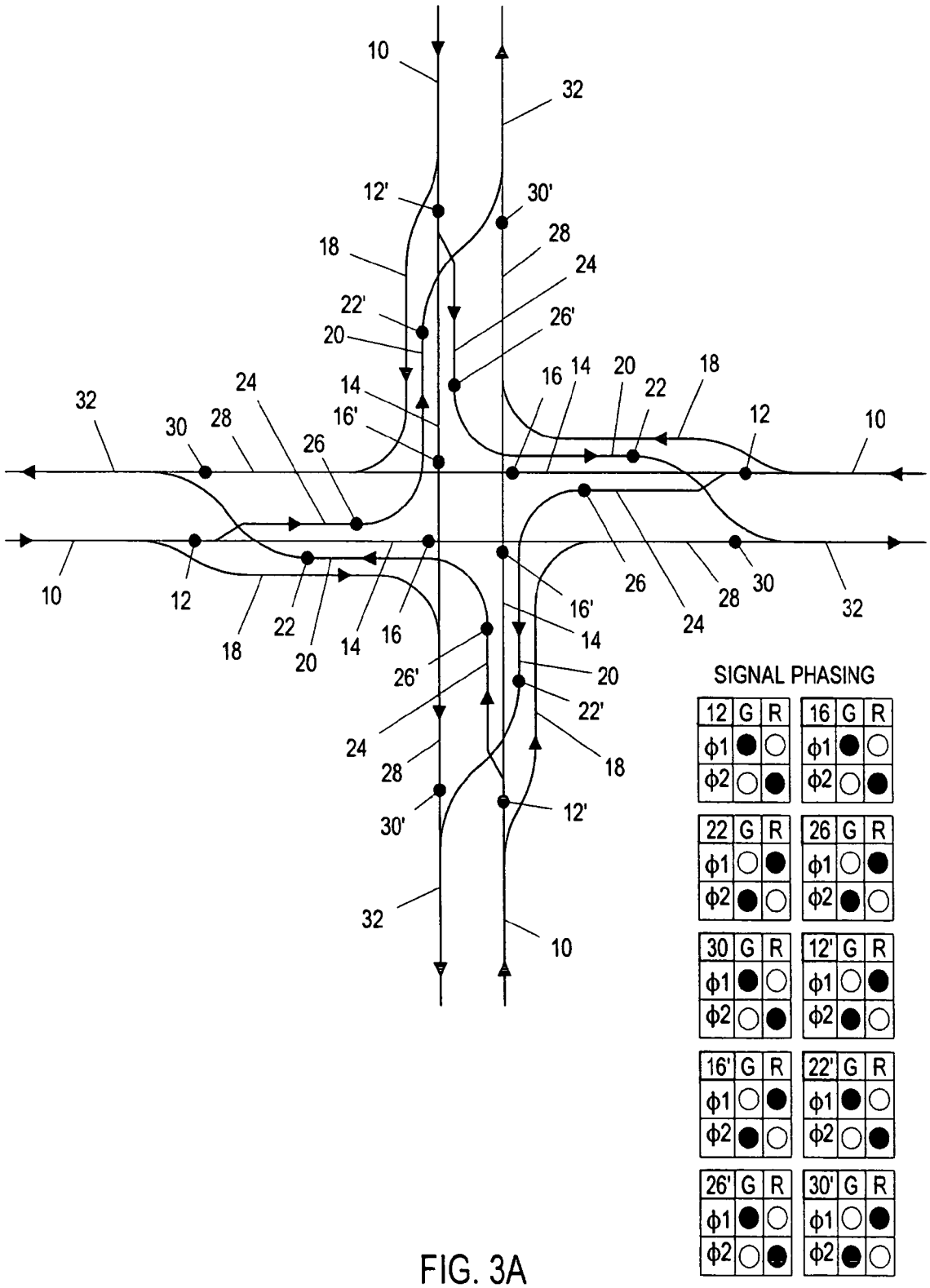
FIG. 3A shows a two-phase four-legged parallel flow intersection embodiment as a line diagram.
Figure 3B:
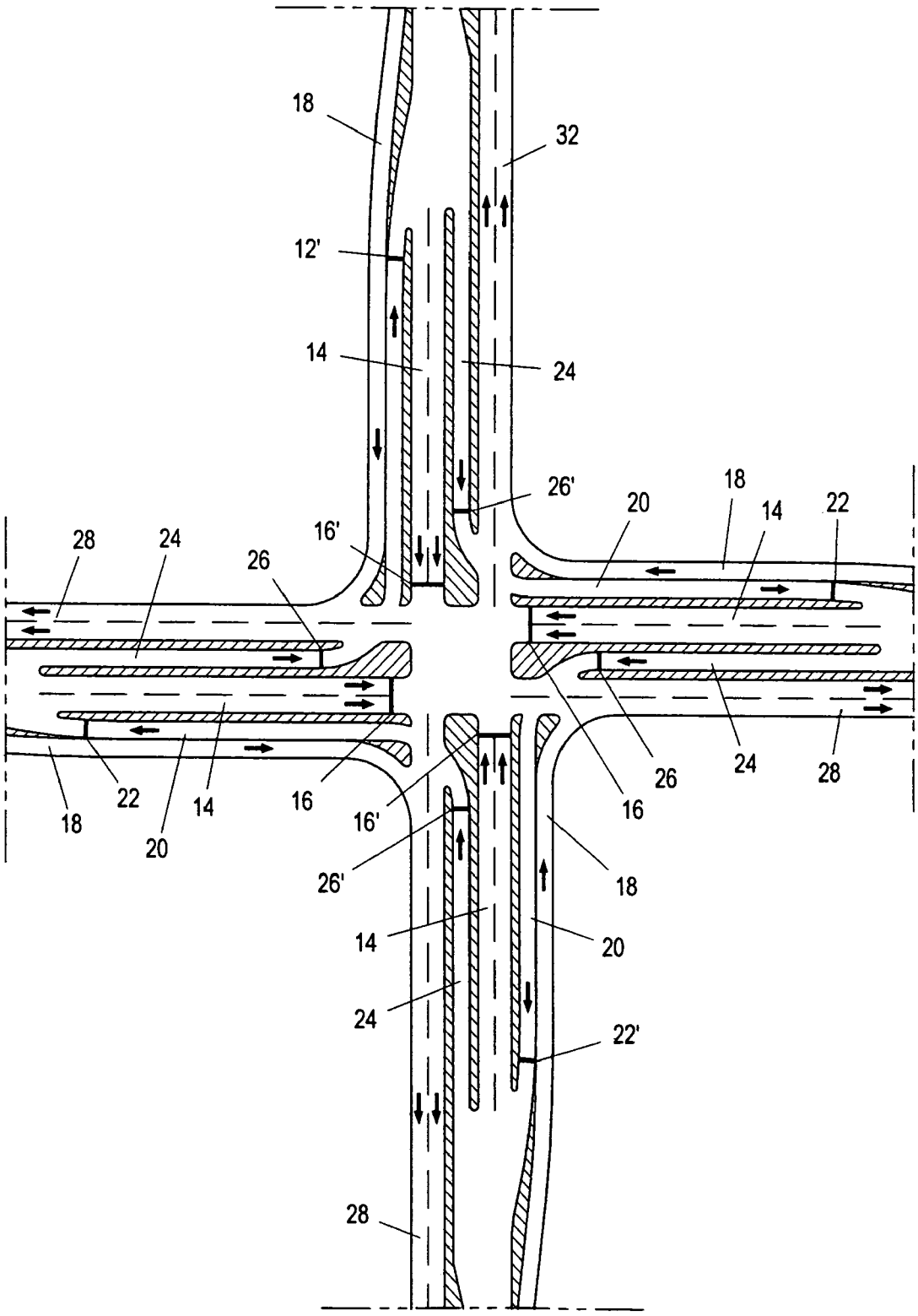
FIGS. 3B to 3F show a two-phase four-legged parallel flow intersection embodiment in detail.
Figure 3C:
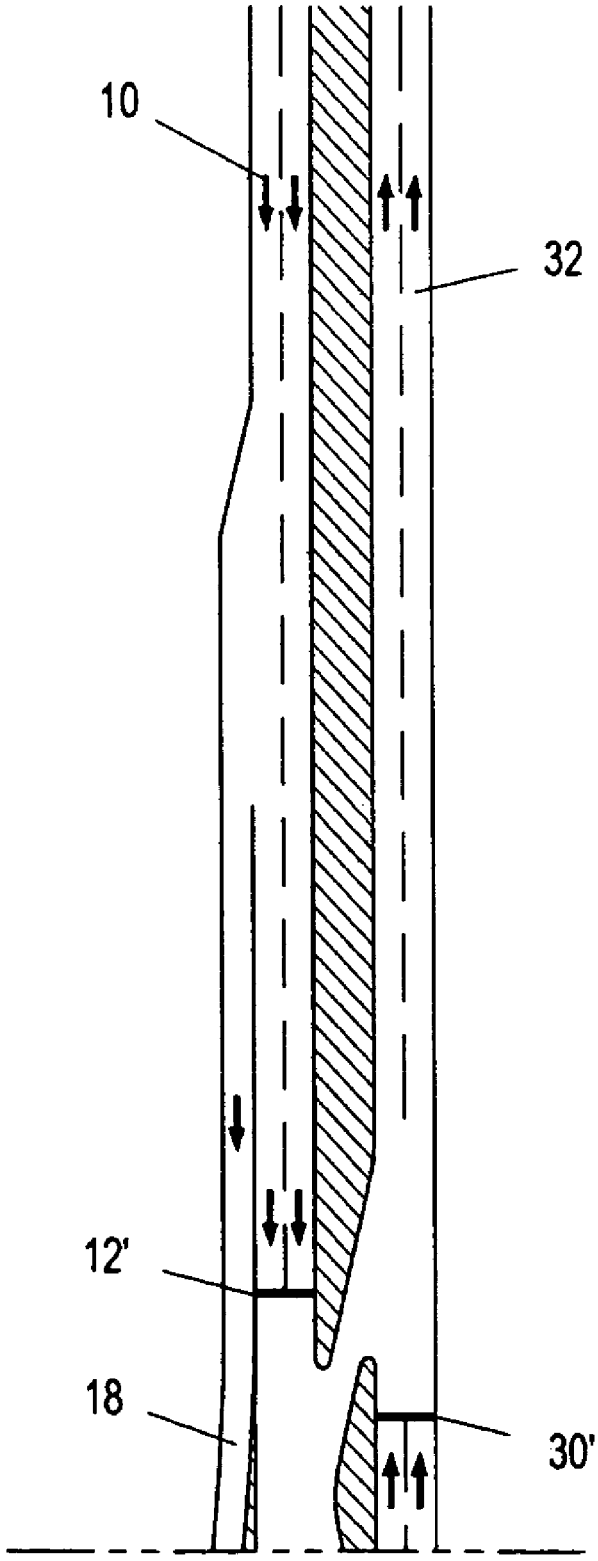
Figure 3D:
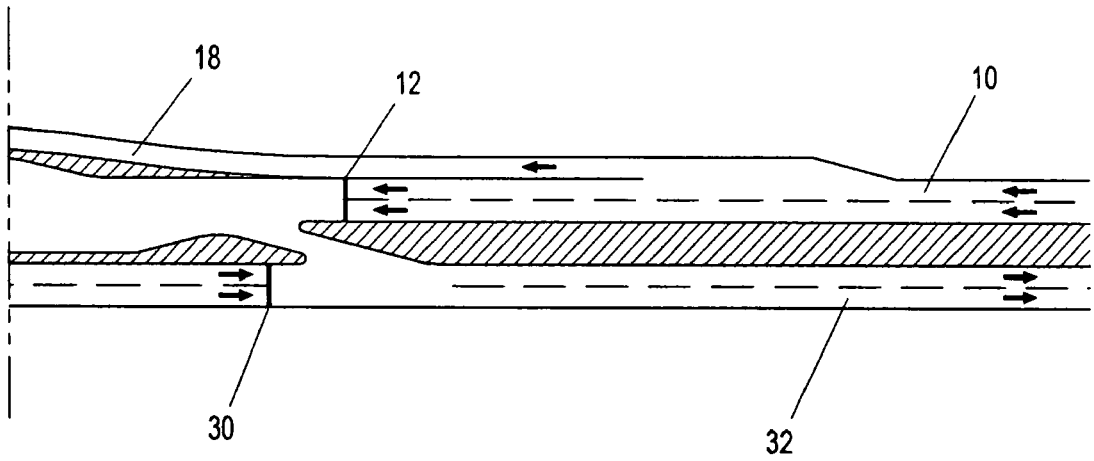
Figure 3E:
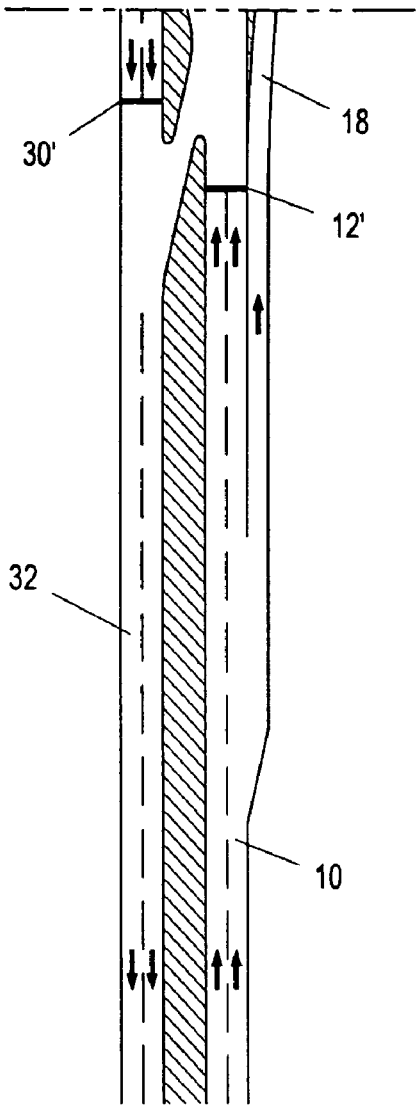
Figure 3F:
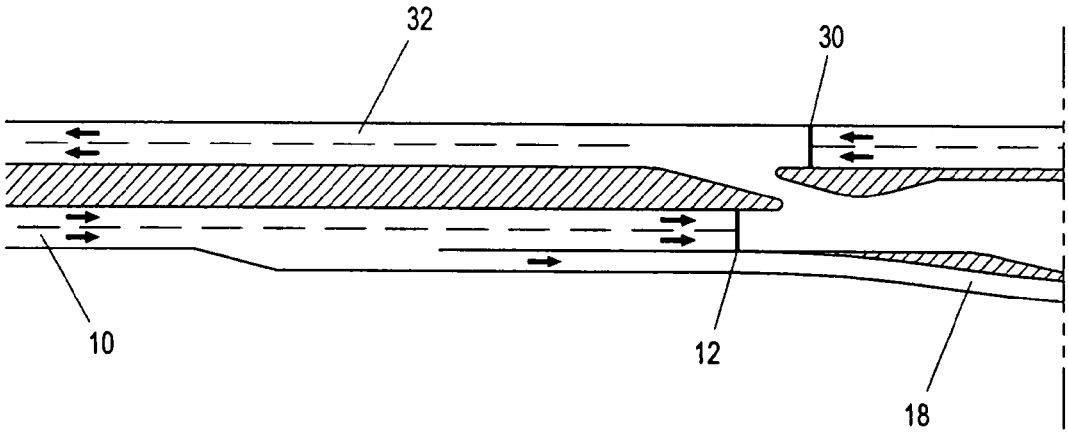

An additional embodiment of the parallel flow vehicle turn system as applied to each leg of a two phase per signal cycle four leg intersection at grade is illustrated in the line diagram in FIG. 3A. The intersection roadways consist of approach lanes 10, approach lane signal means 12, 12', approach thru lanes 14, approach thru signal means 16, 16', departure thru lanes 28, departure thru signal means 30, and departure lanes 32. The intersection turnways consist of opposed turn center lanes 24, opposed turn center signal means 26, 26', opposed turn bypass lanes 20, opposed turn bypass signal means 22, 22', and merged turn bypass lanes 18.

Operation—FIGS. 3A to 3F

Figure 4:
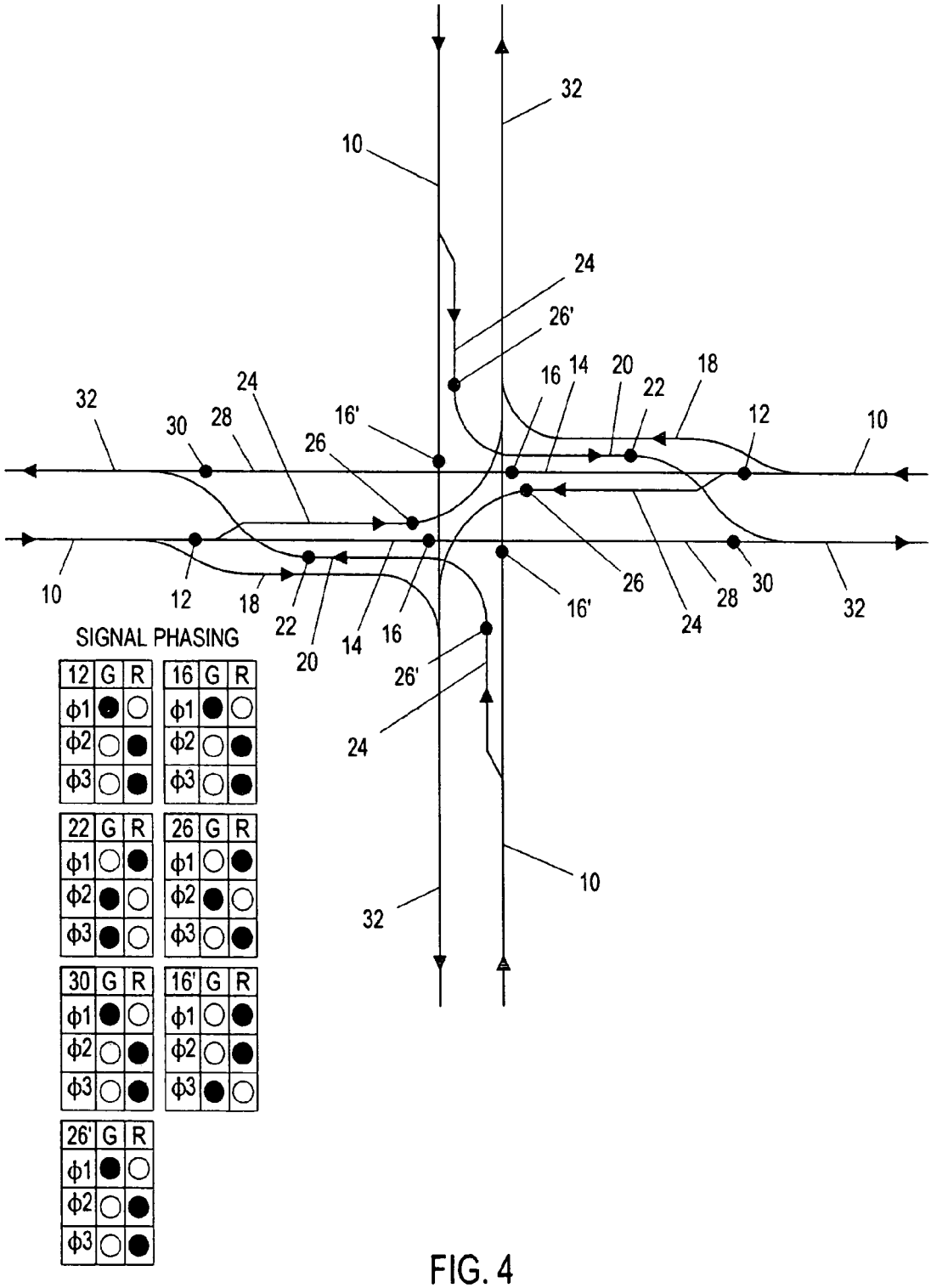
FIG. 4 shows a three-phase four-legged parallel flow intersection embodiment as a line diagram.

During signal phase ϕ1 of a repeating two-phase signal cycle, the following traffic operations can occur for the two-phase four leg parallel flow intersection embodiment:

1) thru traffic on east-west roadway approach lanes 10 receive a green indication from signal means 12 and proceed onto the approach thru lanes 14;

2) thru traffic on east-west roadway approach thru lanes 14 receive a green indication from signal means 16 and proceed through the intersection onto departure thru lanes 28;

3) departing traffic on east-west roadway departure thru lanes 28 receive a green indication from signal means 30 and proceed onto departure lanes 32 then exit the intersection;

4) opposed turn traffic on east-west roadway opposed turn center lanes 24 receive a red indication from signal means 26 and are stopped;

5) opposed turn traffic on east-west roadway opposed turn bypass lanes 20 receive a green indication from signal means 22', proceed onto north-south roadway departure lanes 32, then exit the intersection;

6) thru traffic on north-south roadway approach lanes 10 receive a red indication from signal means 12' and are stopped;

7) thru traffic on north-south roadway approach thru lanes 14 receive a red indication from signal means 16' and are stopped;

8) departing traffic on north-south roadway departure thru lanes 28 receive a red indication from signal means 30' and are stopped;

9) opposed turn traffic on north-south roadway opposed turn center lanes 24 receive a green indication from signal means 26' and proceed onto the north-south roadway opposed turn bypass lanes 20;

10) opposed turn traffic on north-south roadway opposed turn bypass lanes 20 receive a red indication from signal means 22 and are stopped;

11) merged turn traffic on east-west roadway approach lanes 10 turn onto east-west roadway merged turn bypass lanes and merge onto north-south roadway departure thru lanes 28;

12) merged turn traffic on north-south roadway approach lanes 10 turn onto north-south roadway merged turn bypass lanes and merge onto east-west roadway departure thru lanes 28;

During signal phase ϕ2, the following traffic operations can occur for the two-phase four leg parallel flow intersection embodiment:

1) thru traffic on east-west roadway approach lanes 10 receive a red indication from signal means 12 and are stopped;

2) thru traffic on east-west roadway approach thru lanes 14 receive a red indication from signal means 16 and are stopped;

3) departing traffic on east-west roadway departure thru lanes 28 receive a red indication from signal means 30 and are stopped;

4) opposed turn traffic on east-west roadway opposed turn center lanes 24 receive a green indication from signal means 26 and proceed onto east-west roadway opposed turn bypass lanes 20;

5) opposed turn traffic on east-west roadway opposed turn bypass lanes 20 receive a red indication from signal means 22' and are stopped;

6) thru traffic on north-south roadway approach lanes 10 receive a green indication from signal means 12' and proceed onto north-south approach thru lanes 14;

7) thru traffic on north-south roadway approach thru lanes 14 receive a green indication from signal means 16' and proceed onto north-south departure thru lanes 28;

8) departing traffic on north-south roadway departure thru lanes 28 receive a green indication from signal means 30', proceed onto north-south departure lanes then exit the intersection;

9) opposed turn traffic on north-south roadway opposed turn center lanes 24 receive a red indication from signal means 26' and are stopped;

10) opposed turn traffic on north-south roadway opposed turn bypass lanes 20 receive a green indication from signal means 22, proceed onto east-west departure lanes, then exit the intersection;

11) merged turn traffic on east-west roadway approach lanes 10 turn onto east-west roadway merged turn bypass lanes and merge onto north-south roadway departure thru lanes 28;

12) merged turn traffic on north-south roadway approach lanes 10 turn onto north-south roadway merged turn bypass lanes and merge onto east-west roadway departure thru lanes 28;

DETAILED DESCRIPTION—FIG. 4—ADDITIONAL EMBODIMENT—THREE PHASE FOUR LEG INTERSECTION

Another embodiment of the parallel flow vehicle turn system as illustrated in the line diagram in FIG. 4 provides for a three phase per signal cycle four leg intersection of two roadways intersecting at grade. Two opposing roadway legs can have a lane and signal means arrangement consistent with the preferred embodiment and operates in three signal phases. This embodiment is useful when available space is limited for a two signal phase parallel flow intersection. The intersection roadways consist of approach lanes 10, approach lane signal means 12, approach thru lanes 14, approach thru signal means 16, 16', departure thru lanes 28, departure thru signal means 30, and departure lanes 32. The intersection turnways consist of opposed turn center lanes 24, opposed turn center signal means 26, 26', opposed turn bypass lanes 20, opposed turn bypass signal means 22, and merged turn bypass lanes 18.

Operation—FIG. 4

During signal phase ϕ1 of a repeating three-phase signal cycle, the following traffic operations can occur for the three-phase four leg parallel flow intersection embodiment:

1) thru traffic on east-west roadway approach lanes 10 receive a green indication from signal means 12 and proceed onto the approach thru lanes 14;

2) thru traffic on east-west roadway approach thru lanes 14 receive a green indication from signal means 16 and proceed through the intersection onto departure thru lanes 28;

3) departing traffic on east-west roadway departure thru lanes 28 receive a green indication from signal means 30 and proceed onto departure lanes 32 then exit the intersection;

4) opposed turn traffic on east-west roadway opposed turn center lanes 24 receive a red indication from signal means 26 and are stopped;

5) thru traffic on north-south roadway approach lanes 10 receive a red indication from signal means 16' and are stopped;

6) opposed turn on north-south roadway opposed turn center lanes 24 receive a green indication from signal means 26' and proceed onto north-south roadway opposed turn bypass lanes 20;

7) opposed turn traffic on north-south opposed turn bypass lanes 20 receive a red indication from signal means 22 and are stopped.

During signal phase ϕ2, the following traffic operations can occur for the three-phase four leg parallel flow intersection embodiment:

1) thru traffic on east-west roadway approach lanes 10 receive a red indication from signal means 12 and are stopped;

2) thru traffic on east-west roadway approach thru lanes 14 receive a red indication from signal means 16 and are stopped;

3) departing traffic on east-west roadway departure thru lanes 28 receive a red indication from signal means 30 and are stopped;

4) opposed turn traffic on east-west roadway opposed turn center lanes 24 receive a green indication from signal means 26 and proceed to turn onto north-south roadway departure lanes 32 then exit the intersection;

5) thru traffic on north-south roadway approach lanes 10 receive a red indication from signal means 16' and are stopped;

6) opposed turn on north-south roadway opposed turn center lanes 24 receive a red indication from signal means 26' and are stopped;

7) opposed turn traffic on north-south opposed turn bypass lanes 20 receive a green indication from signal means 22, proceed onto east-west roadway departure lanes 32, and then exit the intersection.

During signal phase ϕ3, the following traffic operations can occur for the three-phase four leg parallel flow intersection embodiment:

1) thru traffic on east-west roadway approach lanes 10 receive a red indication from signal means 12 and are stopped;

2) thru traffic on east-west roadway approach thru lanes 14 receive a red indication from signal means 16 and are stopped;

3) departing traffic on east-west roadway departure thru lanes 28 receive a red indication from signal means 30 and are stopped;

4) opposed turn traffic on east-west roadway opposed turn center lanes 24 receive a red indication from signal means 26 and are stopped;

5) thru traffic on north-south roadway approach lanes 10 receive a green indication from signal means 16', proceed onto north-south roadway departure lanes 32 then exit the intersection;

6) opposed turn on north-south roadway opposed turn center lanes 24 receive a red indication from signal means 26' and are stopped;

7) opposed turn traffic on north-south opposed turn bypass lanes 20 receive a green indication from signal means 22, proceed onto east-west roadway departure lanes 32, and then exit the intersection.

DETAILED DESCRIPTION—FIG. 5—ADDITIONAL EMBODIMENT—THREE LEG INTERSECTION

Figure 5:
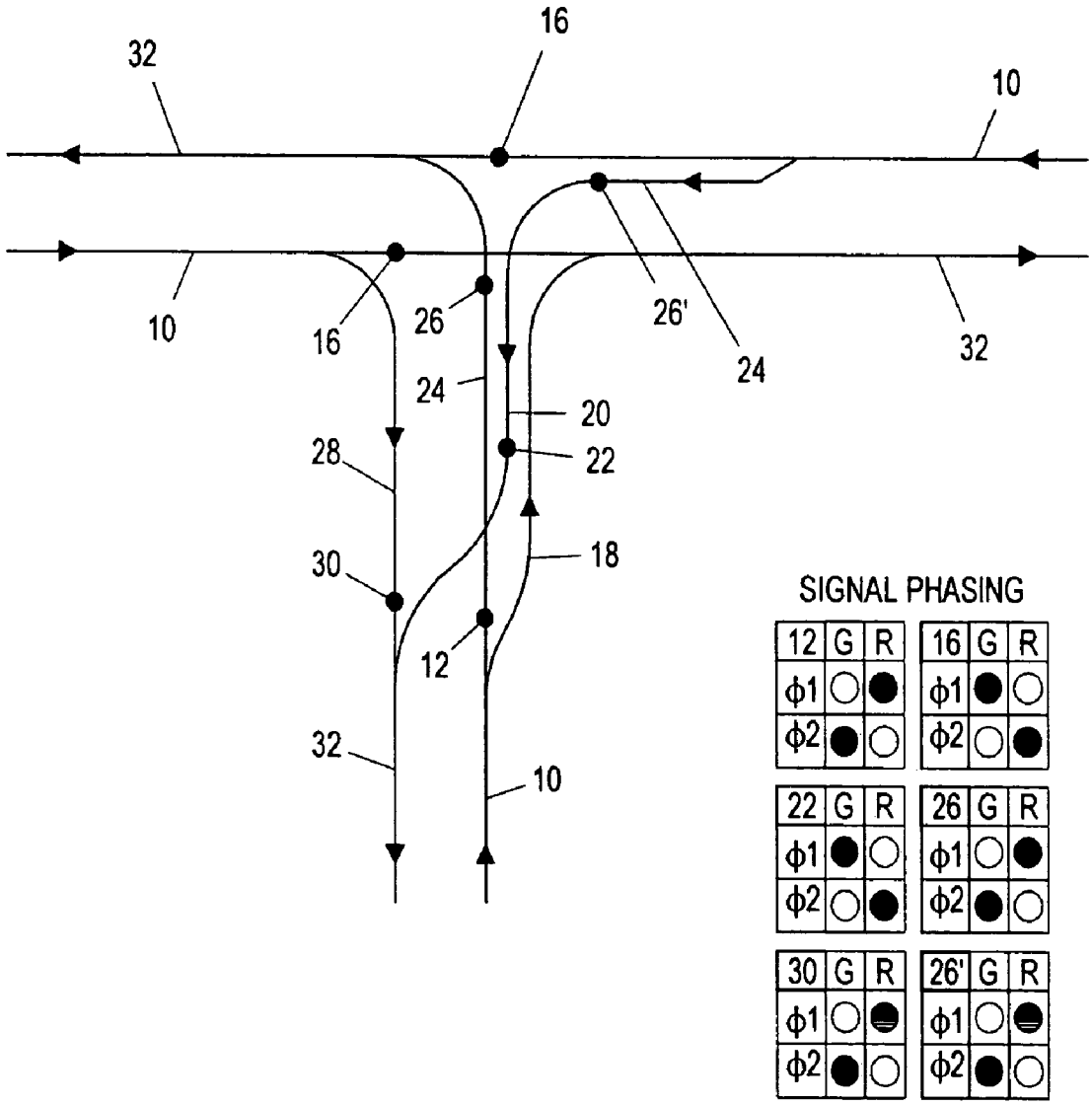
FIG. 5 shows a three-legged or T-type parallel flow intersection embodiment as a line diagram.

An additional embodiment of the parallel flow vehicle turn system as illustrated in the line diagram in FIG. 5 accommodates a three leg or T-type intersection of two roadways intersecting at grade operating in two phases per repeating signal cycle. The intersection roadways consist of approach lanes 10, approach signal means 12, approach thru signal means 16, departure thru lanes 28, departure thru signal means 30, and departure lanes 32. The intersection turnways consist of opposed turn center lanes 24, opposed turn center signal means 26, 26', opposed turn bypass lanes 20, opposed turn bypass signal means 22, and merged turn bypass lanes 18.

Operation—FIG. 5

During signal phase ϕ1 of a repeating two-phase signal cycle, the following traffic operations can occur for the three leg 'T' type parallel flow intersection embodiment:

1) thru traffic on east-west roadway approach lanes 10 receive a green indication from signal means 16, proceed onto east-west roadway departure lanes 32, then exit the intersection;

2) opposed turn traffic on east-west roadway opposed turn center lanes 24 receive a red indication from signal means 26 and are stopped;

3) opposed turn traffic on east-west roadway opposed turn bypass lanes 20 receive a green indication from signal means 22, proceed onto north-south roadway departure lanes 32, then exit the intersection;

4) approaching traffic on north-south roadway approach lanes 10 receive a red indication from signal means 12 and are stopped;

5) opposed turn traffic on north-south roadway opposed turn center lanes 24 receive a red indication from signal means 26 and are stopped;

6) merged turn traffic on east-west roadway approach lanes 10 turn onto north-south roadway departure thru lanes 28, receive a red indication from signal means 30, and are stopped;

7) merged turn traffic on north-south roadway approach lanes 10 turn onto north-south roadway merged turn bypass lanes 18, merge onto east-west roadway departure lanes 32, and then exit the intersection.

During signal phase ϕ2, the following traffic operations can occur:

1) thru traffic on east-west roadway approach lanes 10 receive a red indication from signal means 16 are stopped;

2) opposed turn traffic on east-west roadway opposed turn center lanes 24 receive a green indication from signal means 26 and proceed onto east-west opposed turn bypass lanes 20;

3) opposed turn traffic on east-west roadway opposed turn bypass lanes 20 receive a red indication from signal means 22 and are stopped;

4) approaching traffic on north-south roadway approach lanes 10 receive a green indication from signal means 12 and proceed onto;

5) opposed turn traffic on north-south roadway opposed turn center lanes 24 receive a red indication from signal means 26 and are stopped;

6) merged turn traffic on east-west roadway approach lanes 10 turn onto north-south roadway departure thru lanes 28, receive a red indication from signal means 30, and are stopped;

7) merged turn traffic on north-south roadway approach lanes 10 turn onto north-south roadway merged turn bypass lanes 18, merge onto east-west roadway departure lanes 32, and then exit the intersection.

Figure 6:
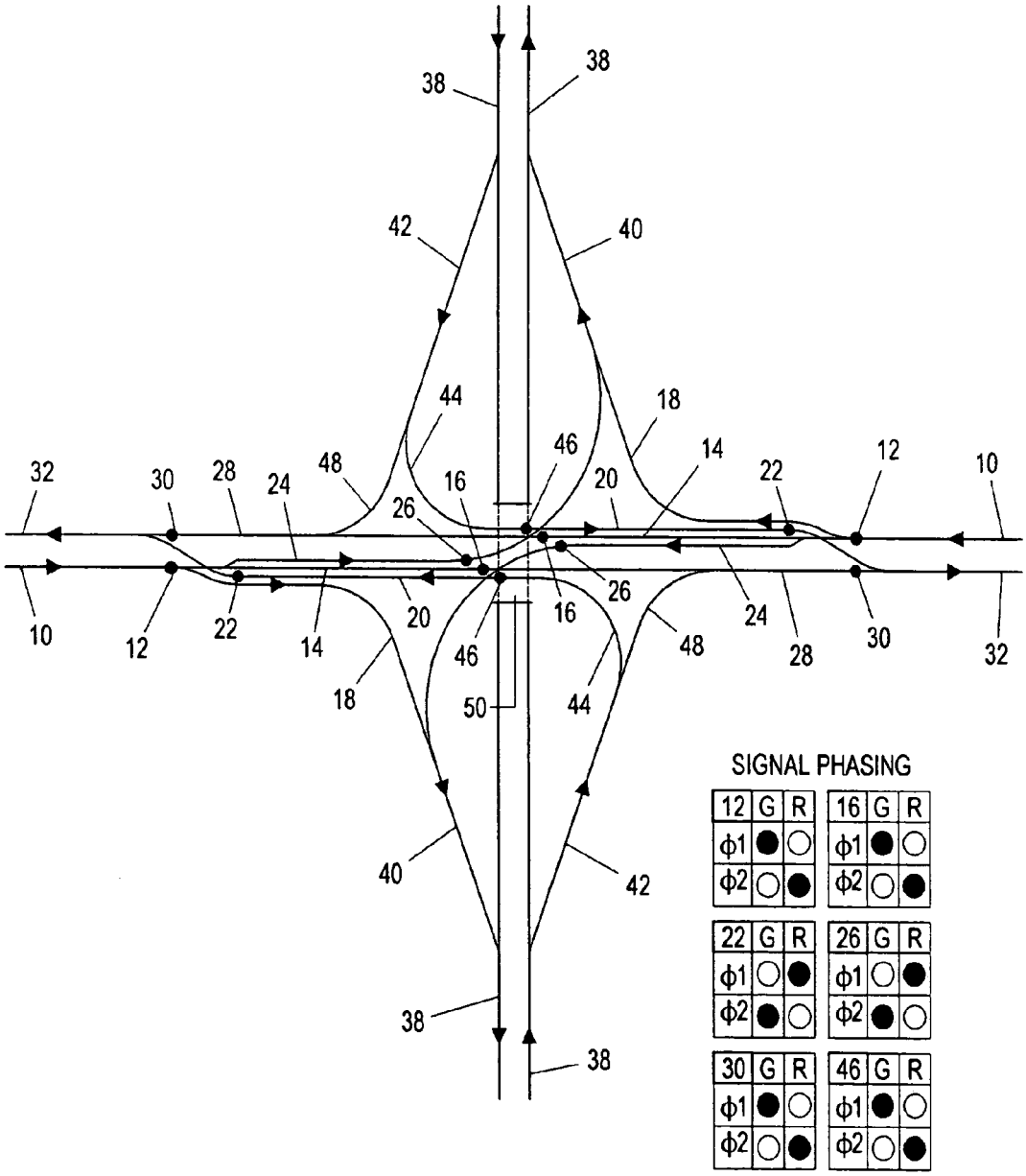
FIG. 6 shows the parallel flow diamond interchange embodiment as a line diagram.

DETAILED DESCRIPTION—FIG. 6—ADDITIONAL EMBODIMENT—PARALLEL FLOW DIAMOND INTERCHANGE

Another embodiment of the parallel flow vehicle turn system as illustrated in the line diagram in FIG. 6 provides for a diamond type interchange. Depicted in FIG. 6 is two intersecting roadways that are grade separated referred to as east-west arterial and north-south freeway wherein the arterial intersection signal means operate in two phases per signal cycle. The interchange arterial roadways consist of approach lanes 10, approach signal means 12, approach thru lanes 14, approach thru signal means 16, departure thru lanes 28, departure thru signal means 30, and departure lanes 32. The interchange arterial turnways consist of merged turn bypass lanes 18, opposed turn center lanes 24, and opposed turn center signal means 26. The interchange ramp roadways consist of freeway entrance ramp lanes 40, freeway exit ramp lanes 42, freeway ramp opposed turn lanes 44, freeway ramp opposed turn signal means 46, and freeway ramp merged turn lanes 48. The interchange freeway consists of freeway lanes 38 and the grade separation is accomplished with a bridge structure 50 over or under the freeway lanes.

Operation—FIG. 6

During signal phase ϕ1 of a repeating two-phase signal cycle, the following traffic operations can occur for the diamond type interchange embodiment:

1) thru traffic on east-west arterial approach lanes 10 receive a green indication from signal means 12 and proceed onto east-west arterial approach thru lanes 14;

2) thru traffic on east-west arterial approach thru lanes 14 receive a green indication from signal means 16 and proceed onto east-west arterial departure thru lanes 28;

3) thru traffic on east-west arterial departure thru lanes receive a green indication from signal means 30, proceed onto east-west arterial departure lanes 32, then exit the intersection;

4) opposed turn traffic on east-west arterial left center lanes 24 receive a red indication from signal means 26 and are stopped;

5) thru traffic on north-south freeway lanes 38 travel freely through the interchange by use of a bridge 50 over or under east-west arterial;

6) opposed turn traffic on north-south freeway lanes 38 exit onto freeway exit ramp lanes 42, approach the intersection, and proceed onto freeway ramp opposed turn lanes 44;

7) opposed turn traffic on north-south freeway ramp opposed turn lanes 44 receive a green indication from signal means 46 and proceed onto freeway ramp opposed turn bypass lanes 20;

8) opposed turn traffic on north-south freeway ramp opposed turn bypass lanes 20 receive a red indication from signal means 22 and are stopped;

9) merged turn traffic on east-west arterial turn onto east-west arterial merged turn bypass lanes 18 and proceed onto freeway entrance ramp lanes 40;

10) traffic on freeway entrance ramp lanes 40 merge onto freeway lanes 38;

11) merged turn traffic on north-south freeway exit ramp lanes 42 travel onto freeway ramp merged turn lanes 48 and merge onto east-west arterial departure thru lanes 28;

During signal phase ϕ2, the following traffic operations can occur for the diamond type interchange embodiment:

1) thru traffic on east-west arterial approach lanes 10 receive a red indication from signal means 12 and are stopped;

2) thru traffic on east-west arterial approach thru lanes 14 receive a red indication from signal means 16 and are stopped;

3) thru traffic on east-west arterial departure thru lanes receive a red indication from signal means 30 are stopped;

4) opposed turn traffic on east-west arterial left center lanes 24 receive a green indication from signal means 26 and proceed to merge onto freeway entrance ramp lanes 40;

5) thru traffic on north-south freeway lanes 38 travel freely through the interchange by use of a bridge 50 over or under east-west arterial;

6) opposed turn traffic on north-south freeway lanes 38 exit onto freeway exit ramp lanes 42, approach the intersection, and proceed onto freeway ramp opposed turn lanes 44;

7) opposed turn traffic on north-south freeway ramp opposed turn lanes 44 receive a red indication from signal means 46 and are stopped;

8) opposed turn traffic on north-south freeway ramp opposed turn bypass lanes 20 receive a green indication from signal means 22, proceed onto east-west arterial departure lanes 32, then exit the intersection;

9) merged turn traffic on east-west arterial turn onto east-west arterial merged turn bypass lanes 18 and proceed onto freeway entrance ramp lanes 40;

10) traffic on freeway entrance ramp lanes 40 merge onto freeway lanes 38;

11) merged turn traffic on north-south freeway exit ramp lanes 42 travel onto freeway ramp merged turn lanes 48 and merge onto east-west arterial departure thru lanes 28.

Figure 7:
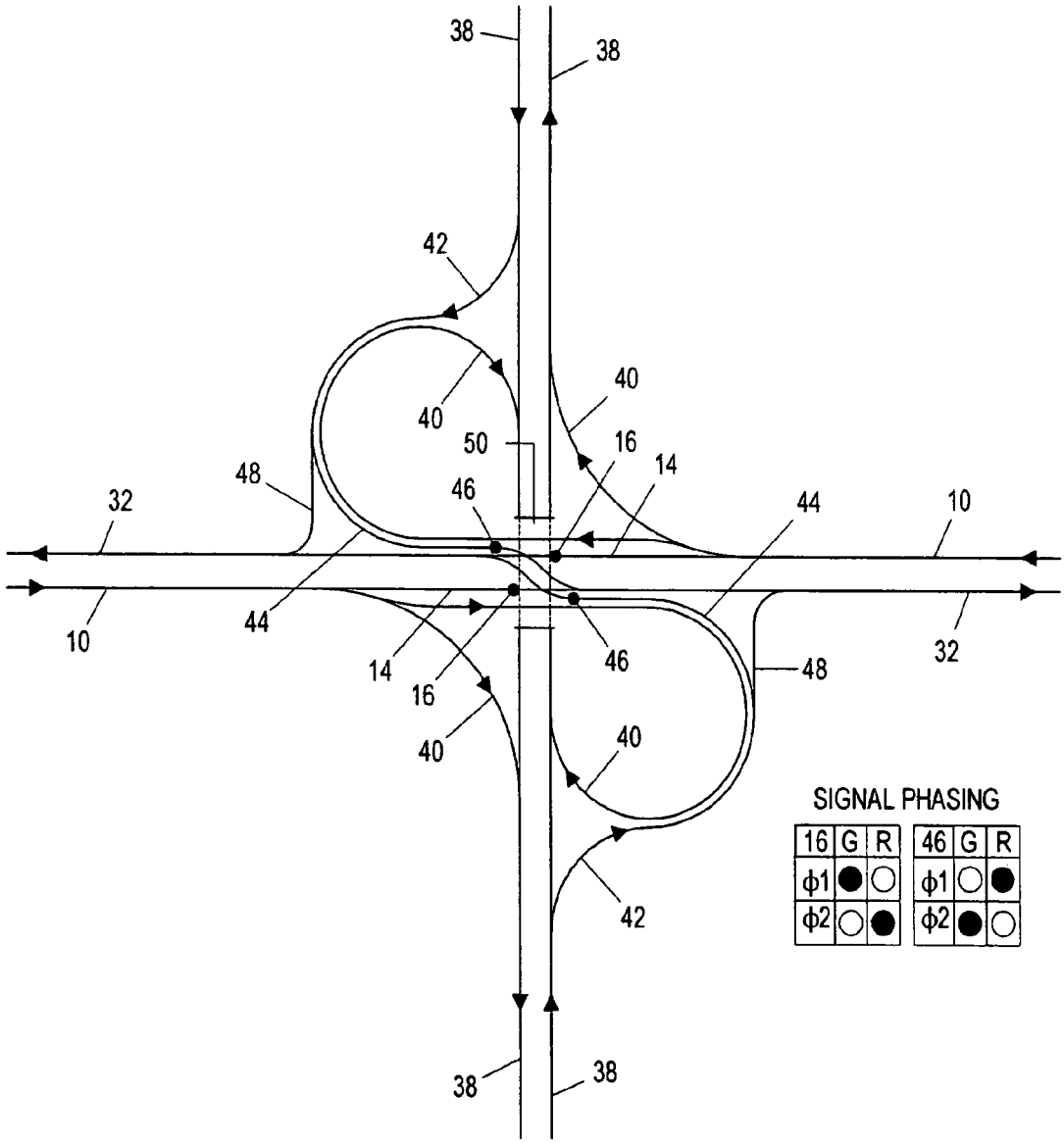
FIG. 7 shows the parallel flow partial cloverleaf loop-on freeway interchange embodiment as a line diagram.

DETAILED DESCRIPTION—FIG. 7—ADDITIONAL EMBODIMENT—PARALLEL FLOW PARTIAL CLOVERLEAF LOOP ON INTERCHANGE

Another embodiment of the parallel flow vehicle turn system as illustrated in the line diagram in FIG. 7 provides for a partial cloverleaf type interchange with loop ramp merging onto the freeway. Depicted in FIG. 7 is an interchange showing an east-west arterial and north-south freeway wherein the arterial intersection signal means operate in two phases per signal cycle. The interchange arterial roadways consist of approach lanes 10, approach thru lanes 14, approach thru signal means 16, and departure lanes 32. The interchange ramp roadways consist of freeway entrance ramp lanes 40, freeway exit ramp lanes 42, freeway ramp opposed turn lanes 44, freeway ramp opposed turn signal means 46, and freeway ramp merged turn lanes 48. The interchange freeway consists of freeway lanes 38 and the grade separation is accomplished with a bridge structure 50 over or under the freeway lanes.

Operation—FIG. 7

Figure 8:
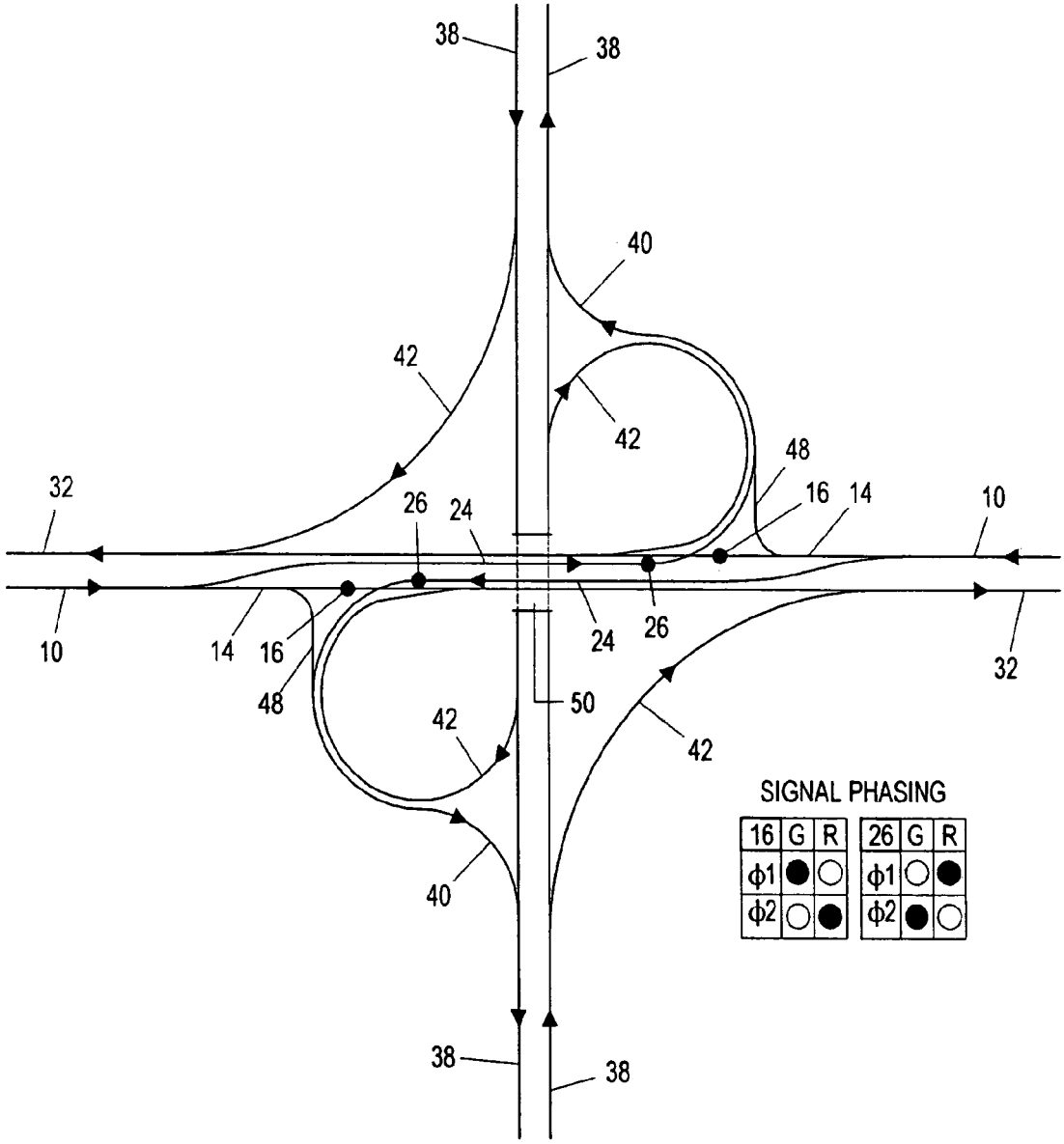
FIG. 8 shows the parallel flow partial cloverleaf loop-off freeway interchange embodiment as a line diagram.

During signal phase ϕ1 of a repeating two-phase signal cycle, the following traffic operations can occur for the partial cloverleaf loop-on interchange embodiment:

1) thru traffic on east-west arterial approach lanes 10 proceed onto approach thru lanes 14 or onto freeway entrance ramp lanes 40;

2) thru traffic on east-west arterial approach thru lanes 14 receive a green indication from signal means 16, proceed onto east-west arterial departure lanes 32, then exit the intersection;

3) thru traffic on north-south freeway lanes 38 travel freely through the interchange by use of a bridge 50 over or under east-west arterial;

4) opposed turn traffic on north-south freeway lanes 38 exit onto freeway exit ramp lanes 42, approach the intersection, and proceed onto freeway ramp opposed turn lanes 44;

5) opposed turn traffic on north-south freeway ramp opposed turn lanes 44 receive a red indication from signal means 46 and are stopped;

6) traffic on freeway entrance ramp lanes 40 merge onto freeway lanes 38;

7) merged turn traffic on north-south freeway exit ramp lanes 42 travel onto freeway ramp merged turn lanes 48, merge onto east-west arterial departure lanes 32, then exit the intersection;

During signal phase ϕ2, the following traffic operations can occur for the partial cloverleaf loop-on interchange embodiment:

1) thru traffic on east-west arterial approach lanes 10 proceed onto approach thru lanes 14 or onto freeway entrance ramp lanes 40;

2) thru traffic on east-west arterial approach thru lanes 14 receive a red indication from signal means 16 and are stopped;

3) thru traffic on north-south freeway lanes 38 travel freely through the interchange by use of a bridge 50 over or under east-west arterial;

4) opposed turn traffic on north-south freeway lanes 38 exit onto freeway exit ramp lanes 42, approach the intersection, and proceed onto freeway ramp opposed turn lanes 44;

5) opposed turn traffic on north-south freeway ramp opposed turn lanes 44 receive a green indication from signal means 46, proceed onto east-west arterial departure lanes, then exit the intersection;

6) traffic on freeway entrance ramp lanes 40 merge onto freeway lanes 38;

7) merged turn traffic on north-south freeway exit ramp lanes 42 travel onto freeway ramp merged turn lanes 48, merge onto east-west arterial departure lanes 32, then exit the intersection;

DETAILED DESCRIPTION—FIG. 8—ADDITIONAL EMBODIMENT—PARALLEL FLOW PARTIAL CLOVERLEAF LOOP OFF INTERCHANGE

Another embodiment of the parallel flow vehicle turn system as illustrated in the line diagram in FIG. 8 provides for a partial cloverleaf type interchange with loop ramp exiting from freeway. Depicted in FIG. 8 is an intersection grade separated showing an east-west arterial and north-south freeway wherein the arterial intersection signal means operate in two phase per cycle. The interchange arterial roadways consist of approach lanes 10, approach thru lanes 14, approach thru signal means 16, and departure lanes 32. The interchange arterial turnways consist of opposed turn center lanes 24 and opposed turn center signal means 26. The interchange ramp roadways consist of freeway entrance ramp lanes 40, freeway exit ramp lanes 42, freeway ramp opposed turn lanes 44, freeway ramp opposed turn signal means 46, and freeway ramp merged turn lanes 48. The interchange freeway consists of freeway lanes 38 and the grade separation is accomplished with a bridge structure 50 over or under the freeway lanes.

Operation—FIG. 8

During signal phase ϕ1 of a repeating two-phase signal cycle, the following traffic operations can occur for the partial cloverleaf loop-off interchange embodiment:

1) thru traffic on east-west arterial approach lanes 10 proceed onto approach thru lanes 14 or onto freeway entrance ramp lanes 40;

2) thru traffic on east-west arterial approach thru lanes 14 receive a green indication from signal means 16, proceed onto east-west arterial departure lanes 32, then exit the intersection;

3) thru traffic on north-south freeway lanes 38 travel freely through the interchange by use of a bridge 50 over or under east-west arterial;

4) opposed turn traffic on east-west arterial left center lanes 24 receive a red indication from signal means 26 and are stopped;

5) opposed turn traffic on north-south freeway lanes 38 exit onto freeway exit ramp lanes 42, merge onto east-west arterial departure lanes 32, then exit the intersection;

6) traffic on freeway entrance ramp lanes 40 merge onto freeway lanes 38;

7) merged turn traffic on north-south freeway exit ramp lanes 42, merge onto east-west arterial departure lanes 32, then exit the intersection;

During signal phase ϕ2, the following traffic operations can occur for the partial cloverleaf loop-off interchange embodiment:

1) thru traffic on east-west arterial approach lanes 10 proceed onto approach thru lanes 14;

2) thru traffic on east-west arterial approach thru lanes 14 receive a red indication from signal means 16 and are stopped;

3) thru traffic on north-south freeway lanes 38 travel freely through the interchange by use of a bridge 50 over or under east-west arterial;

4) opposed turn traffic on east-west arterial left center lanes 24 receive a green indication from signal means 26, proceed onto freeway entrance ramp lanes 40, then merge onto freeway lanes 38;

5) opposed turn traffic on north-south freeway lanes 38 exit onto freeway exit ramp lanes 42, approach the intersection, and proceed onto freeway ramp opposed turn lanes 44;

6) traffic on freeway entrance ramp lanes 40 merge onto freeway lanes 38;

7) merged turn traffic on north-south freeway exit ramp lanes 42 travel onto freeway ramp merged turn lanes 48, merge onto east-west arterial departure lanes 32, then exit the intersection;

Advantages

From the description above, my invention provides a number of advantages over conventional signalized intersections:

(a) The intersection operates with substantially higher efficiency due to the two- or three-phase per repeating signal cycle operation, thus materially reducing delay to the traveling public.

(b) With higher efficiency, my intersection will improve air quality by reducing idle time of traffic that would otherwise result from being delayed.

(c) By reducing the number of unprotected vehicle conflict points, my intersection will be safer than conventional intersections.

(d) Due to the efficiency gains over a conventional intersection, the high cost of interchange construction may be avoided.

(e) The intersection can improve access to corner properties by providing less restricted ingress and egress than traditional intersections that may be restricted to "right-in-right-out" drive access where opposed turn lanes are present.

(f) Impacts to environmental or national resources protected by law may be avoided due to achieving greater efficiency gains in smaller spaces than a traffic interchange.

In addition to advantages over conventional signalized intersections, the parallel flow intersection offers the following advantages over the displaced opposed turn intersection:

(a) My intersection requires less space thus potentially resulting in fewer impacts to private properties or protected resources.

(b) The DLT begins the opposed turn a substantial distance away from the intersection making for a confusing and less intuitive opposed turn for drivers while my intersection places the opposed turn at the intersection in a similar fashion as traditional opposed turns.

(c) The large radius reverse curves forming the DLT opposed turn cross over allows for high speed crossing of opposing traffic. This condition may contribute to wrong way accidents where drivers confuse the opposing approach lanes with the opposed turn bypass lanes. My intersection uses small radius curves where traffic must slow down for a safer turn.

(d) Because my intersection requires less length on the approach, more distance is provided for traffic weaving than the DLT.

(e) Access to corner properties is improved with my intersection. By adding a opposed turn slot to provide a route onto the merged turn bypass, corner property ingress and egress can be achieved from any direction. The DLT restricts access to the corner properties where the opposed turn bypass blocks opposed turn egress.

(f) My intersection provides for easier constructability of retrofitting an existing intersection than the DLT by generally requiring new pavement construction to occur only on the outsides of the existing intersection. Construction can then take place with only minor interruptions to traffic operations.

(g) Cost of my intersection will generally be less than the DLT due to the factors cited above. Lower impacts, less construction, less interruption of traffic during construction, and safety advantages should result in my intersection being a lower cost and more effective intersection alternative to the traveling public.

CONCLUSION, RAMIFICATIONS, AND SCOPE

Accordingly, the reader will understand that the parallel flow vehicle turn system when applied to congested traffic intersections and interchanges can provide substantial travel delay savings over more costly conventional improvements. Aside from reducing delay, the parallel flow intersection should cause relatively low impacts to surrounding properties and offer improved access to corner properties. Additional to the operational benefits of this invention, there can be substantially fewer impacts to private property or protected resources than traditional capacity improvement projects.

Furthermore, the parallel flow intersection has the additional advantages of:

- improving safety with use of a raised traffic island in front of vehicle occupying the opposed turn center lanes and eliminating permitted opposed turns;
- improving air quality by reducing vehicle delay and idle time;
- reducing construction time and minimizing inconvenience to the public caused by construction activities;

Although the description above contains many specificities, these should not be construed as limiting the scope of the invention but as merely providing illustrations of some of the presently preferred embodiments of this invention. For example, the intersection can be configured in many different ways based on number of lanes; two-phase or three-phase signal operation; varying angle of approach legs; merged turn without merged turn bypass lanes; right hand or left hand direction of travel, etc.

Thus the scope of the invention should be determined by the appended claims and their legal equivalents, rather than the examples given.

I claim:

1. A traffic intersection vehicle turn system comprising:

a) a pair of intersecting roadways forming a vehicle opposed turn contained within a traffic intersection at grade comprising an origination roadway for said vehicle opposed turns to begin and a destination roadway to receive said vehicle opposed turns, b) said origination roadway comprising origination roadway approach lanes and signal means to accommodate traffic approaching said traffic intersection, origination roadway departure lanes to accommodate traffic departing said traffic intersection, and center turn lanes to accommodate traffic performing opposed turns, c) said destination roadway comprising destination roadway approach lanes and signal means to accommodate traffic approaching said traffic intersection and destination roadway departure lanes to accommodate traffic departing said traffic intersection, d) said center turn lanes located between said origination roadway approach lanes and said origination roadway departure lanes containing a center turn traffic signal means for regulating traffic flow from said center turn lanes, e) vehicle opposed turn bypass lanes substantially parallel to said destination roadway approach lanes and located on the side of said destination roadway approach lanes opposite to said destination departure lanes, f) a junction formed at grade by intersecting said vehicle opposed turn bypass lanes with said destination roadway containing approach lanes signal means located on said destination roadway approach lanes, departure lanes signal means located on said destination roadway departure lanes, and vehicle opposed turn bypass lanes signal means located on said vehicle opposed turn bypass lanes whereby said signal means regulates traffic flow on said destination roadway with traffic flow from said vehicle opposed turn bypass lanes, whereby said traffic intersection vehicle opposed turn system can permit said traffic intersection signal operation to be conducted in two or three signal phases per signal cycle with said vehicle opposed turns completed in two separate phases of said traffic intersection signal operation.

2. A traffic intersection vehicle turn system as in claim 1, wherein said destination roadway vehicle merged turns are accommodated by vehicle merged turn bypass lanes located substantially parallel to said vehicle opposed turn bypass lanes and along opposite side of said vehicle opposed turn bypass lanes from said destination roadway approach lanes to form a junction with said origination roadway departure lanes, whereby said arrangement of roadway lanes permits said vehicle merged turn traffic to bypass said vehicle opposed turn traffic and merge with traffic on said origination roadway departure lanes.

3. A traffic intersection vehicle turn system as in claim 1, wherein a first roadway and a second roadway intersect at grade forming four intersection legs such that each said intersection leg pair of adjacent legs forming a vehicle opposed turn containing said traffic intersection vehicle turn system respectively whereby said traffic intersection signal operation can be conducted in two phases per repeating traffic signal cycle such that, a) said first roadway approach and departure signal means, said second roadway center turn signal means, and said first roadway vehicle opposed turn bypass signal means permit travel in a substantially concurrent first signal phase while all other signal controlled traffic movements contained within said traffic intersection are stopped, b) said second roadway approach and departure signal means, said first roadway center turn signal means, and said second roadway vehicle opposed turn bypass signal means permit travel in a substantially concurrent second signal phase while all other signal controlled traffic movements contained within said traffic intersection are stopped.

4. A traffic intersection vehicle turn system as in claim 1, wherein a first roadway and a second roadway intersect at grade forming four intersection legs and each pair of said legs forming a vehicle opposed turn whereby said traffic intersection vehicle turn system is applied to opposed turns from said first roadway onto said second roadway whereby said traffic intersection signal operation can be conducted in three phases per repeating traffic signal cycle such that;

a) said first roadway approach signal means and said first roadway vehicle opposed turn bypass signal means permit travel in a substantially concurrent first signal phase while all other signal controlled traffic movements contained within said traffic intersection are stopped, b) said second roadway approach and departure signal means, and said first roadway center turn signal means permit travel in a substantially concurrent second signal phase while all other signal controlled traffic movements contained within said traffic intersection are stopped, c) said second roadway center turn signal means permit travel in a third signal phase substantially while all other signal controlled traffic movements contained within said traffic intersection are stopped.

5. A traffic intersection vehicle turn system as in claim 1, wherein a first roadway and a second roadway intersect at grade forming three intersection legs or 'T' type intersection such that said traffic intersection vehicle turn system is applied to one leg pair forming an opposed turn from said first roadway onto said second roadway whereby said traffic intersection signal operation can be conducted in two phases per repeating traffic signal cycle such that;

a) said first roadway approach and departure signal means and said second roadway center turn signal means permit travel in a substantially concurrent first signal phase while all other signal controlled traffic movements contained within said traffic intersection are stopped, b) said second roadway approach signal means and said second roadway opposed turn bypass signal means permit travel in a substantially concurrent second signal phase while all other signal controlled traffic movements contained within said traffic intersection are stopped.

6. A traffic intersection vehicle turn system as in claim 1, wherein a freeway and an arterial roadway intersect grade separated in a diamond-type interchange configuration comprising;

a) freeway exit ramps and freeway entrance ramps intersecting with said arterial roadway at grade such that said freeway ramps form two opposing intersection legs substantially bisected longitudinally by said freeway, b) said traffic intersection vehicle turn system applied to each said freeway exit ramp and said arterial roadway junction whereby said traffic intersection signal operation can be conducted in two phases per repeating traffic signal cycle such that;

c) said arterial roadway approach and departure signal means and said freeway exit ramp opposed turn signal means permit travel in a substantially concurrent first signal phase while all other signal controlled traffic movements contained within said traffic intersection are stopped, d) said freeway exit ramp opposed turn bypass signal means and said arterial roadway center turn signal means permit travel in a substantially concurrent second signal phase while all other signal controlled traffic movements contained within said traffic intersection are stopped.

7. A traffic intersection such that a freeway and arterial roadway intersect by grade separation means in a partial cloverleaf-type interchange configuration with loop ramp means for exiting from said arterial roadway and is formed by said freeway exit ramps with said arterial roadway, comprising;

a) arterial roadway approach lanes to accommodate traffic approach said traffic intersection and arterial roadway departure lanes to accommodate traffic departing said traffic intersection, b) freeway entrance ramp accommodating vehicle merged turn traffic traveling from said arterial roadway to said freeway without use of said grade separation means, c) freeway entrance loop ramp accommodating vehicle opposed turn traffic traveling to said freeway using said grade separation means and substantially forming a circular loop, d) said arterial roadway approach thru lanes and signal means, e) said freeway exit ramp substantially outside of and concentric to said freeway entrance loop ramp and signal means, f) a junction formed by each leg of said arterial roadway and each said freeway exit ramp, whereby a single intersection is formed containing said arterial approach thru lanes and signal means and said freeway exit ramp and signal means whereby said traffic intersection signal operation can be conducted in two phases per repeating traffic signal cycle such that, g) said first roadway approach thru lanes signal means permit travel in a first signal phase while all other signal controlled traffic movements contained within said traffic intersection are stopped, h) said freeway exit ramp signal means permit travel in a second signal phase while all other signal controlled traffic movements contained within said traffic intersection are stopped.

8. A traffic intersection such that a freeway and arterial roadway intersect by grade separation means in a partial cloverleaf-type interchange configuration with loop ramp means for exiting from said freeway and is formed by said freeway entrance ramps with said arterial roadway, comprising;

a) arterial roadway approach lanes to accommodate traffic approach said traffic intersection and arterial roadway departure lanes to accommodate traffic departing said traffic intersection, b) freeway entrance ramp accommodating vehicle merged turn traffic traveling from said arterial roadway to said freeway without use of said grade separation means, c) vehicle opposed turn center lanes and signal means located between said arterial roadway departure lanes and said arterial roadway opposite leg opposed turn center lanes accommodating vehicle opposed turn traffic traveling to said freeway using said grade separation means and adjoining said freeway entrance ramp to form a continuous travel path, d) said arterial roadway approach thru lanes and signal means, e) said freeway entrance ramp substantially outside of and concentric to said freeway exit loop ramp, f) a junction formed by said arterial roadway approach thru lanes and said vehicle opposed turn center lanes, whereby a single intersection is formed with said arterial approach thru lanes and signal means with said vehicle opposed turn center lanes and signal means whereby said traffic intersection signal operation can be conducted in two phases per repeating traffic signal cycle such that, g) said first roadway approach thru lanes signal means permit travel in a first signal phase while all other signal controlled traffic movements contained within said traffic intersection are stopped, h) said vehicle opposed turn center lanes signal means permit travel in a second signal phase while all other signal controlled traffic movements contained within said traffic intersection are stopped.

* * * * *